United States Patent [19]

Frentrup et al.

[11] Patent Number: 4,626,366

[45] Date of Patent: Dec. 2, 1986

[54] FUNCTIONAL FLUIDS AND CONCENTRATES CONTAINING ASSOCIATIVE POLYETHER THICKENERS AND CERTAIN METAL DIALKYLDITHIOPHOSPHATES

[75] Inventors: Mark A. Frentrup, Dearborn; Stanley T. Hirozawa, Birmingham; James E. Carson, Lincoln Park; Daniel E. Coker, Woodhaven, all of Mich.

[73] Assignee: BASF Corporation, Wyandotte, Mich.

[21] Appl. No.: 568,865

[22] Filed: Jan. 6, 1984

[51] Int. Cl.[3] ..... C10M 3/42

[52] U.S. Cl. ..... 252/32.7 E; 252/49.5; 252/78.5; 252/52 R; 252/51.5 R

[58] Field of Search ..... 252/32.7 E, 49.5, 78.5, 252/52 R, 51.5 R, 316

[56] References Cited

U.S. PATENT DOCUMENTS

| | | | |
|---|---|---|---|
| 4,210,541 | 7/1980 | Mann | 252/78.5 |
| 4,312,775 | 1/1982 | Panek et al. | 252/78.5 |
| 4,384,965 | 5/1983 | Hellsten et al. | 252/49.5 |
| 4,395,351 | 7/1983 | Camp | 252/78.5 |
| 4,456,539 | 6/1984 | Shim | 252/49.5 |
| 4,481,125 | 11/1984 | Holgodo | 252/32.7 E |

*Primary Examiner*—Jacqueline V. Howard

*Attorney, Agent, or Firm*—Bernhard R. Swick

[57] ABSTRACT

The invention relates to functional fluid concentrates and functional fluids which can be prepared by mixing the concentrates with water. The functional fluids can be used in hydraulic systems or as metalworking compositions to cool and lubricate surfaces which are in frictional contact during operations such as the turning, cutting, peeling, or grinding of metals.

The functional fluid concentrate comprises:

(a) a cloud point raising metal dialkyldithiophosphate additive having the following structural formula:

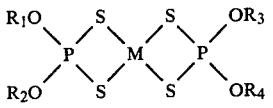

wherein $R_1$, $R_2$, $R_3$, and $R_4$ are individually linear or branched alkyl, alkenyl, aryl, arylalkyl and alkylaryl groups having from 1 to 24 carbon atoms; and M is selected from the group consisting of Zn, Sb, Sn, Mg, and Mn; preferably Zn or Sb;

(b) a polyether nonionic surfactant; and (c) an associative polyether thickener.

Preferably the concentrate also contains a linear or branched alkanolamine having 2 to 10 carbon atoms.

44 Claims, No Drawings

FUNCTIONAL FLUIDS AND CONCENTRATES CONTAINING ASSOCIATIVE POLYETHER THICKENERS AND CERTAIN METAL DIALKYLDITHIOPHOSPHATES

BACKGROUND OF THE INVENTION

1. Field of the Invention

This invention relates to functional fluids and concentrates thickened with associative polyether thickeners. In addition to the associative polyether thickener, the fluids and concentrates also contain a cloud point raising additive which is a metal dialkyldithiophosphate, a polyether nonionic surfactant, preferably an alkanolamine, and other optional ingredients.

2. Description of the Prior Art

It is known to formulate functional fluids with associative polyether thickeners. See, for instance, U.S. Pat. Nos. 4,411,819 and 4,312,768. However, the fluids described in these patents have wear rates of approximately 20 milligrams per hour, and have cloud points of approximately 160° F. Because of the high wear, these fluids are not satisfactory in pumps which operate under severe conditions such as vane pumps which may operate at high pressures (greater than 500 psi), or in systems which may have sump temperatures above 150° F. or localized temperatures (such as where directional valves are placed) as high as 200° F.

SUMMARY OF THE INVENTION

The invention relates to functional fluid concentrates and functional fluids which can be prepared by mixing the concentrates with water. The functional fluids can be used in hydraulic systems or as metalworking compositions to cool and lubricate surfaces which are in frictional contact during operations such as the turning, cutting, peeling, or the grinding of metals.

The functional fluid concentrate comprises:

(a) a cloud point raising metal dialkyldithiophosphate additive having the following structural formula:

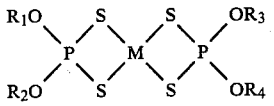

wherein $R_1$, $R_2$, $R_3$ and $R_4$ are individually linear or branched alkyl, alkenyl, aryl, arylalkyl, or alkylaryl groups having from 1 to 24 carbon atoms, preferably 2 to 20; and M is selected from the group consisting of Zn, Sb, Sn, Mg, and Mn; preferably Zn or Sb;

(b) a polyether nonionic surfactant; and (c) an associative polyether thickener.

Preferably the concentrate also contains a linear or branched alkanolamine having 2 to 20 carbon atoms.

Functional fluids can be prepared from the subject concentrate by diluting the concentrate with water such that approximately 60 to 99.9 percent of the fluid will consist of water. Alternatively, some or all of the water of dilution may be replaced by a freezing point lowering additive such as ethylene glycol, propylene glycol, butylene glycol, diethylene glycol, dipropylene glycol, triethylene glycol, tetraethylene glycol, and the like, or mixtures thereof. Functional fluids prepared with the subject concentrates have viscosities which may exceed 200 SUS at 100° F. which is substantially maintained at increased temperatures. They also have cloud points as high as 205° F. and, thus, are able to be utilized in systems which may have sump temperatures or localized temperatures (such as might exist where directional valves are placed) of up to 200° F. or higher. In the Vickers Vane Pump Test, a widely used test of the antiwear properties of a hydraulic fluid, the fluids will generally have wear rates of less than 10 mg/hour and are likely to have wear rates of less than 5 mg/hour over long term operations such as 100 hours or more.

DESCRIPTION OF THE PREFERRED EMBODIMENTS

The cloud point raising additive is a metal dialkyldithiophosphate having a structure defined by formula I previously set forth. Particularly useful as the cloud point raising additive is the compound wherein M is Zn and all R groups are 2-ethylhexyl. These additives are well known in the art particularly those where M is Zn and are commercially available.

In general, any polyether nonionic surfactant can be used in the practice of this invention provided that it will mix with the associative thickener, cloud point raising additive and other ingredients in water. Such polyether nonionic surfactants are well known in the art. They are prepared by reacting an alkylene oxide with an active hydrogen-containing compound to form a molecule having an average molecular weight of approximately 300 to 10,000, preferably 500 to 5000, and most preferably 500 to 2000, which contains a hydrophobe segment and a hydrophile segment. However, they do not contain a hydrophobe segment based upon an alpha-olefin epoxide or glycidyl ether addition as do the associative thickeners described in a subsequent part of this specification.

Although other polyether nonionic surfactants may work satisfactorily, three groups of surfactants have been shown to work particularly well. The most preferred group consists of polyether nonionic surfactants prepared by reacting a preferably aliphatic alcohol, fatty acid, fatty acid amide, amine initiator (preferably an alcohol initiator) having about 12 to about 18 carbon atoms, preferably about 12 to about 15 carbon atoms, with ethylene oxide to prepare a homopolymer containing the residue of about 5 to about 100 moles of ethylene oxide. Preferably, about 5 to about 20 moles of ethylene oxide are reacted with the initiator to prepare said homopolymer polyether surfactants. Alternatively, block or heteric copolymers can be prepared using as reactants ethylene oxide and a lower alkylene oxide, preferably having 3 to 4 carbon atoms. The residue of ethylene oxide in said polyether copolymer generally is at least about 70 percent by weight when the lower alkylene oxide used with ethylene oxide has 3 carbon atoms. The ethylene oxide residue in the polyether obtained generally is about 80 percent by weight when a lower alkylene oxide containing 4 carbon atoms is utilized with ethylene oxide in the preparation of said ethoxylated surfactant. Preferably, the average molecular weight of said surfactant is about 500 to about 2000. Representative aliphatic alcohol or amine initiators are octadecyl alcohol, stearyl amine, lauryl alcohol, lauryl amine, myristyl alcohol or amine, and cetyl alcohol or amine.

Another preferred group of polyether nonionic surfactants is ethoxylated alkyl phenols having 1 to about 20 carbon atoms in the alkyl group and preferably an average molecular weight of about 400 to about 2000. These are derived from reaction of an alkyl phenol with ethylene oxide to produce a homopolymer. Alternatively, a block or heteric copolymer can be prepared by reacting ethylene oxide and a lower alkylene oxide, preferably having 3 to 4 carbon atoms, with an alkyl phenol. The alkyl phenol preferably has about 4 to about 20 carbon atoms in the alkyl group. Preferably, the ethoxylated alkyl phenols are derived from the reaction of said alkyl phenol with ethylene oxide or ethylene oxide and at least one lower alkylene oxide, preferably having 3 to 4 carbon atoms, provided that the ethoxylated polyether copolymer surfactant obtained thereby contains at least 60 percent to about 96 percent by weight of ethylene oxide residue. The ethoxylated homopolymer alkyl phenols contain the residue.of about 5 to about 100 moles of ethylene oxide. Representative alkyl phenols useful in the preparation of alkoxylated alkyl phenol surfactants are octylphenol, nonylphenol, dodecylphenol, dioctyphenol, dinonylphenol, dodecylphenol and mixtures thereof.

The final group of preferred polyether nonionic surfactants consists of ethylene oxide adducts of sorbitol and sorbitan mono-, di-, and triesters having average molecular weights of 500 to 5000, preferably 500 to 2000. These surfactants are well known in the art. These surfactants are generally prepared by esterifying 1 to 3 moles of a fatty acid and then further reacting with ethylene oxide. The fatty acids usually contain from 10 to 20 carbon atoms, preferably 12 to 18 carbon atoms. Alternatively, a block or heteric copolymer can be prepared by reacting ethylene oxide and a lower alkylene oxide, preferably having 3 to 4 carbon atoms with the fatty acid ester. Preferably the surfactants are prepared by the reaction of the ester with ethylene oxide or ethylene oxide and at least one lower alkylene oxide preferably having 3 to 4 carbon atoms provided that the ethoxylated polyether copolymer surfactant obtained thereby contains from about 20 percent to about 90 percent by weight of ethylene oxide residue. The ethoxylated homopolymers contain the residue of about 5 to about 100 moles of ethylene oxide. They are commercially sold under the INDUSTROL® trademark. Particularly useful are INDUSTROL® L20-S, INDUSTROL® 020-S, INDUSTROL® S20-S, INDUSTROL® 68, and INDUSTROL® 1186.

The concentrate generally contains about 0.5 to about 10.0 parts by weight of the polyether surfactant, preferably about 1.0 to about 5.0 parts by weight per 1.0 part by weight of the cloud point raising additive.

The associative polyether thickeners which are used in the subject concentrates and functional fluids are relatively new in the art and are disclosed in U.S. Pat. Nos. 4,288,639; 4,312,775; and 4,411,819 which are incorporated herein by reference. These thickeners are prepared by first reacting ethylene oxide or ethylene oxide and generally at least one lower alkylene oxide with at least one active hydrogen-containing compound and subsequently reacting therewith at least one long chain aliphatic alpha-olefin epoxide or glycidyl ether. The long chain alpha-olefin epoxide or glycidyl ether has a carbon chain length of about 12 to about 18 aliphatic carbon atoms. The proportion of alpha-olefin epoxide or glycidyl ether present in the polyether thickener is generally 1 to about 20 percent by weight, based upon the total weight of the thickener.

The associative polyether polyol thickeners may be readily prepared by modifying a conventional non-associative polyether aqueous thickener by reacting it with an alpha-olefin epoxide or glycidyl ether having about 12 to about 18 carbon atoms or mixtures thereof. The conventional non-associative polyether polyol thickener can be an ethylene oxide-derived homopolymer or a heteric or block copolymer of ethylene oxide and at least one lower alkylene oxide preferably having 3 to 4 carbon atoms. The ethylene oxide is used generally as a reactant in the proportion of at least 10 percent by weight based upon the total weight of the polyether thickener. Preferably, about 60 to 99 percent by weight ethylene oxide is utilized with about 40 to 1 percent by weight of a lower alkylene oxide preferably having 3 to 4 carbon atoms.

The preferred non-associative polyether thickeners used to prepare the associative thickeners are prepared by methods well known in the art. Generally this involves reacting an active hydrogen-containing compound in the presence of an acidic or basic oxyalkylation catalyst and an inert organic solvent at elevated temperatures in the range of about 50° C. to 150° C. under an inert gas pressure, generally from about 20 to about 100 pounds per square inch gauge. Generally, both monohydric and polyhydric alcohol initiators are useful. Useful polyhydric alcohol initiators are selected from the alkane polyols, alkene polyols, alkyne polyols, aromatic polyols, and oxyalkylene polyols. Monohydric alcohol initiators which are useful include aliphatic monohydric alcohols and alkyl phenols containing about 12 to about 18 carbon atoms in the aliphatic or alkyl group. In addition, aliphatic mercaptans having about 12 to about 18 carbon atoms are useful initiators.

In this manner, heteric, block, and homopolymer non-associative polyether thickeners, preferably having average molecular weights of about 1000 to about 60,000, preferably 5000 to 40,000, are prepared which can be used to prepare associative polyether thickeners by reacting them with long chain, aliphatic alpha-olefin epoxides glycidyl ether.

Generally, about 0.01 part to about 50.0 parts by weight, preferably about 0.5 to about 5.0 parts by weight, of the associative polyether thickener is used per 1.0 part by weight of the cloud point raising additive.

As was mentioned previously, concentrates and functional fluids preferably contain linear or branched alkanolamines having from 2 to 20 carbon atoms. Specific examples of alkanolamines which may be used include: monoethanolamine, diethanolamine, triethanolamine, monoisopropanolamine, diisopropanolamine, triisopropanolamine, di-sec-butanolamine, sec-butylaminoethanol, dimethylethanolamine, diethylethanolamine, aminoethylethanolamine, methylethanolamine, butylethanolamine, phenylethanolamine dibutylethanolamine, monoisopropylethanolamine, diisopropylethanolamine, phenylethylethanolamine, methyldiethanolamine, ethyldiethanolamine, phenyldiethanolamine, dimethylisopropanolamine, 2-amino-2-methyl-1-propanol, and 2-amino-2-ethyl-1,3-propanediol.

Particularly useful are triethanolamine, diethylethanolamine, diisopropylethanolamine and mixtures thereof. The alkanolamines are used in amounts of 0.1 part to 20 parts by weight, preferably 0.5 part to 5.0 parts by weight per 1.0 part of the cloud point raising additive.

Other optional ingredients which may be used in the subject concentrates and functional fluids include corrosion inhibitors such as alkali metal nitrites, nitrates, phosphates, silicates and benzoates. Certain amines, other than the alkanolamines previously described, may also be useful. The inhibitors can be used individually or in combinations. Representative examples of the preferred alkali metal nitrates and benzoates which are useful are as follows: sodium nitrate, potassium nitrate, calcium nitrate, barium nitrate, lithium nitrate, strontium nitrate, sodium benzoate, potassium benzoate, calcium benzoate, barium benzoate, lithium benzoate and strontium benzoate.

Representative amine type corrosion inhibitors are morpholine, N-methylmorpholine, N-ethylmorpholine, triethylenediamine, ethylenediamine, dimethylaminopropylamine, and piperazine.

The metal deactivators may also be used in the subject concentrates and functional fluids. Such materials are well known in the art and individual compounds can be selected from the broad classes of materials useful for this purpose such as the various triazoles and thiazoles as well as the amine derivatives of salicylidenes. Representative specific examples of these metal deactivators are as follows: benzotriazole, tolyltriazole, 2-mercaptobenzothiazole, sodium 2-mercaptobenzothiazole, and N,N'-disalicylidene-1,2-propanediamine.

The corrosion inhibitors and metal deactivators are generally used in amounts of from about 0.001 part to 5.0 parts by weight, preferably 0.001 part to 0.2 part by weight per 1.0 part of the cloud point raising additive.

The examples which follow will illustrate the practice of this invention in more detail. However, they are not intended in any way to limit its scope. All parts, proportions, and percentages are by weight, and all temperatures are in degrees Fahrenheit unless otherwise specified.

The following abbreviations will be used in the Examples:

AMP—2-amino-2-methyl-1-propanol

DIPAE—N,N-diisopropyl-2-aminoethanol

E-69—a 20 mole ethylene oxide adduct of sorbitan trioleate

P-45—a 4 mole propylene oxide adduct of pentaerythritol

Surfactant A—an ethylene oxide adduct of a mixture of $C_{12}$–$C_{15}$ alcohols having an average molecular weight of 500 to 600

Surfactant B—a 9 mole ethylene oxide adduct of nonylphenol

Surfactant C—a 13 mole ethylene oxide adduct of a stearic acid

TEA—triethanolamine

Thickener #1—a non-associative polyether thickener having an average molecule weight of 23,000 prepared by reacting a mixture of ethylene oxide and propylene oxide (using an ethylene oxide/propylene oxide weight ratio of 75:25) with trimethylolpropane Thickener #2—an associative polyether thickener having an average molecular weight of approximately 17,000 prepared by reacting a mixture of ethylene oxide and propylene oxide (weight ratio of ethylene oxide to propylene oxide of approximately 85:15) to form a heteric intermediate, and then reacting the intermediate with approximately 4 to 5 weight percent of a mixture of $C_{15}$–$C_{18}$ alpha olefin epoxides.

TT—tolyltriazole (50 percent solution)

ZDP-1—zinc dialkyldithiophosphate wherein all R groups are 2-ethylhexyl

ZDP-2—zinc dialkyldithiophosphate wherein the R groups are a mixture of isodecyl isomers ZDP-3—zinc dialkyldithiophosphate wherein the R groups have an average of 3.8 carbon atoms ZDP-4—antimonydialkyldithiophosphate wherein all R groups are 2-ethylhexyl

EXAMPLES

Comparative Example A

A hydraulic fluid was formulated by mixing 92.75 parts of water with 7.25 parts of a concentrate having the following proportion of ingredients:

| Ingredient | Parts by Weight |
|---|---|
| TEA | 1.0 |
| DIPAE | 0.7 |
| Surfactant A | 4.0 |
| TT | 0.15 |
| Thickener #2 | 1.4 |

The cloud point for the above fluid was 162° F.

EXAMPLE 1

In order to show the effect of adding an additive within the scope of the subject invention to the formulation in Comparison Example A, several other hydraulic fluids were prepared by adding a metal dialkyldithiophosphate to the concentrate described in Comparison Example A. The specific metal dialkyldithiophosphate and the amount used is given in Table I. In each case the amount of water used in Comparison Example A was reduced by the amount of the metal dialkyldithiophosphate used so that the amounts of all ingredients are based upon 100 parts of fluid.

TABLE I

| Example | Additive | Amount (pbw) | Cloud point (°F.) |
|---|---|---|---|
| 1 | ZDP-3 | 1.0 | 181 |
| 2 | ZDP-1 | 0.5 | 195 |
| 3 | ZDP-1 | 1.0 | 206 |
| 4 | ZDP-2 | 1.5 | 200 |
| 5 | ZDP-4 | 1.0 | 206 |

Examples 1–5 show that the additives of this invention effectively raise the cloud point of the subject hydraulic fluid.

The next Examples, 6–7, illustrate that this phenomenon occurs when other surfactants are used. In these Examples, the following proportions of ingredients were used:

| Ingredient | Parts by Weight |
|---|---|
| DIPAE | 1.0 |
| TEA | 0.5 |
| Surfactant B or C | 4.0 |
| ZDP-1 | 1.0 |
| Thickener #2 | 1.3 |

When Surfactant B was used, the cloud point was 203° F. When Surfactant C was used, the cloud point was 198° F.

Comparison Example B

For comparison purposes, a fluid was formulated having the formulation of the fluid described in Comparison Example A except that 20 parts of Thickener #1 was used instead of 1.4 parts of Thickener #2. (Also, 72.65 parts by weight of water were used instead of 92.75 parts by weight.) The fluid had a cloud point of 173° F. When 1.5 parts by weight of ZDP-1 were added, the cloud point of the fluid was increased to 175° C.

This comparison indicates that additives such as ZDP-1 are not effective for raising the cloud point of fluids containing thickeners such as Thickener #1 even though it does raise the cloud point of fluids having thickeners such as Thickener #2.

Examples 8–12 will illustrate what wear rates are like for the hydraulic fluids within the scope of this invention. The fluids disclosed in Table II were formulated by mixing the concentrate with water. The wear rates were determined by using the Vickers Vane Pump Test. The hydraulic circuit and equipment used were as specified in ASTM D2882 and D2271.

The Vickers Vane Pump Test procedure used herein specifically requires charging the system with 5 gallons of the test fluid and running at temperatures ranging from 100° to 135° F. at 750 to 1000 psi pump discharge pressure (load). Wear data were made by weighing the cam-ring and the vanes of the "pump cartridge" before and after the test. At the conclusion of the test run and upon disassembly for weighing, visual examination of the system was made for signs of deposits, varnish, corrosion, etc.

The various components and amounts used in the fluids are given in Table II along with the wear rate data.

TABLE II

| Components | 8 | 9 | 10 | 11 | 12 |
|---|---|---|---|---|---|
| Cloud Point Additive | | | | | |
| ZDP-1 | — | 2.0 | — | 2.0 | — |
| ZDP-2 | 2.0 | — | 2.0 | — | — |
| ZDP-3 | — | — | — | — | 1.5 |
| Surfactant A | 2.0 | 2.0 | 2.0 | 2.0 | 4.0 |
| Thickener #2 | 1.5 | 1.55 | 1.4 | 1.6 | 1.4 |
| AMP | — | 1.0 | 1.0 | 1.0 | — |
| DIPAE | 1.0 | — | — | — | 0.7 |
| E-69 | 0.5 | 0.5 | — | — | — |
| P-45 | — | 1.0 | 1.0 | 1.0 | — |
| TEA | — | — | — | — | 1.0 |
| TT | 0.45 | 0.45 | 0.45 | 0.45 | 0.15 |
| Wear Data | | | | | |
| (a) hours tested | 480 | 180 | 66 | 273 | 500 |
| (b) pressure (psi) | 1000 | 1000 | 1000 | 800 | 1000 |
| (c) wear (mg/hr) | 0.6 | 0.11 | 1.1 | 0.64 | 1.1 |

Table II shows that using the concentrates and fluids within the scope of this invention, it is possible to provide effective resistance against wear.

The embodiments of the invention in which an exclusive privilege or property is claimed are defined as follows:

1. A functional fluid concentrate which comprises (a) a cloud point raising additive having the following structural formula:

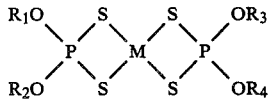

wherein $R_1$, $R_2$, $R_3$, and $R_4$ are individually linear or branched alkyl, alkenyl, aryl, arylakyl, or alkylaryl groups having from 1 to 24 carbon atoms; and M is selected from the group consisting of Zn, Sb, Sn, Mg and Mn:

(b) from 0.5 part to 10.0 parts by weight of a polyether nonionic surfactant; and (c) from 0.01 part to 50.0 parts by weight of an associative polyether thickener, said weights based upon 1.0 part by weight of the cloud point raising additive.

2. The concentrate of claim 1 wherein M is Zn or Sb.

3. The concentrate of claim 2 wherein component (b) is used in an amount of 0.5 part to 5.0 parts by weight; and component (c) is used in an amount of 0.5 part to 5.0 parts by weight, said weights being based upon the weight of the cloud point raising additive.

4. The concentrate of claim 3 wherein a linear or branched alkanolamine is also used in the concentrate.

5. The concentrate of claim 4 wherein a mixture of triethanolamine and diisopropylaminoethanol is used as the alkanolamine component.

6. The concentrate of claim 5 wherein the amount of triethanolamine used is from 0.5 part to 2.5 parts by weight and the amount of diisopropylaminoethanol is from 0.5 part to 1.5 parts by weight based upon the weight of the concentrate.

7. The concentrate of claim 6 which contains tolyltriazole in an amount of 0.001 part to 2.0 parts by weight per 1.0 part by weight of the cloud point raising additive.

8. The concentrate of claim 3 wherein the surfactant is an ethylene oxide adduct of a mixture of $C_{12-15}$ alcohols such that the average molecular weight is from 300 to 5000.

9. The concentrate of claim 4 wherein the surfactant is an ethylene oxide adduct of a mixture of $C_{12-15}$ alcohols such that the average molecular weight is from 300 to 5000.

10. The concentrate of claim 5 wherein the surfactant is an ethylene oxide adduct of a mixture of $C_{12-15}$ alcohols such that the average molecular weight is from 300 to 5000.

11. The concentrate of claim 6 wherein the surfactant is an ethylene oxide adduct of a mixture of $C_{12-15}$ alcohols such that the average molecular weight is from 300 to 5000.

12. The concentrate of claim 7 wherein the surfactant is an ethylene oxide adduct of a mixture of $C_{12-15}$ alcohols such that the average molecular weight is from 300 to 5000.

13. The concentrate of claim 3 wherein the associative thickener has an average molecular weight of 5000 to 40,000 and is prepared by reacting a mixture of ethylene oxide and propylene oxide in a weight ratio of 3:1 to 10:1 with trimethylol propane and then reacting with an alpha-olefin epoxide such that the weight percent of alpha-olefin oxide in the associative thickener is from 1 to 20 percent.

14. The concentrate of claim 4 wherein the associative thickener has an average molecular weight of 5000 to 40,000 and is prepared by reacting a mixture of ethylene oxide and propylene oxide in a weight ratio of 3:1 to 10:1 with trimethylol propane and then reacting with an alpha-olefin epoxide such that the weight percent of alpha-olefin oxide in the associative thickener is from 1 to 20 percent.

15. The concentrate of claim 5 wherein the associative thickener has an average molecular weight of 5000 to 40,000 and is prepared by reacting a mixture of ethylene oxide and propylene oxide in a weight ratio of 3:1 to 10:1 with trimethylol propane and then reacting with an alpha-olefin epoxide such that the weight percent of alpha-olefin oxide in the associative thickener is from 1 to 20 percent.

16. The concentrate of claim 6 wherein the associative thickener has an average molecular weight of 5000 to 40,000 and is prepared by reacting a mixture of ethylene oxide and propylene oxide in a weight ratio of 3:1 to 10:1 with trimethylol propane and then reacting with an alpha-olefin epoxide such that the weight percent of alpha-olefin oxide in the associative thickener is from 1 to 20 percent.

17. The concentrate of claim 7 wherein the associative thickener has an average molecular weight of 5000 to 40,000 and is prepared by reacting a mixture of ethylene oxide and propylene oxide in a weight ratio of 3:1 to 10:1 with trimethylol propane and then reacting with an alpha-olefin epoxide such that the weight percent of alpha-olefin oxide in the associative thickener is from 1 to 20 percent.

18. The concentrate of claim 8 wherein the associative thickener has an average molecular weight of 5000 to 40,000 and is prepared by reacting a mixture of ethylene oxide and propylene oxide in a weight ratio of 3:1 to 10:1 with trimethylol propane and then reacting with an alpha-olefin epoxide such that the weight percent of alpha-olefin oxide in the associative thickener is from 1 to 20 percent.

19. The concentrate of claim 9 wherein the associative thickener has an average molecular weight of 5000 to 40,000 and is prepared by reacting a mixture of ethylene oxide and propylene oxide in a weight ratio of 3:1 to 10:1 with trimethylol propane and then reacting with an alpha-olefin epoxide such that the weight percent of alpha-olefin oxide in the associative thickener is from 1 to 20 percent.

20. The concentrate of claim 10 wherein the associative thickener has an average molecular weight of 5000 to 40,000 and is prepared by reacting a mixture of ethylene oxide and propylene oxide in a weight ratio of 3:1 to 10:1 with trimethylol propane and then reacting with an alpha-olefin epoxide such that the weight percent of alpha-olefin oxide in the associative thickener is from 1 to 20 percent.

21. The concentrate of claim 11 wherein the associative thickener has an average molecular weight of 5000 to 40,000 and is prepared by reacting a mixture of ethylene oxide and propylene oxide in a weight ratio of 3:1 to 10:1 with trimethylol propane and then reacting with an alpha-olefin epoxide such that the weight percent of alpha-olefin oxide in the associative thickener is from 1 to 20 percent.

22. The concentrate of claim 12 wherein the associative thickener has an average molecular weight of 5000 to 40,000 and is prepared by reacting a mixture of ethylene oxide and propylene oxide in a weight ratio of 3:1 to 10:1 with trimethylol propane and then reacting with an alpha-olefin epoxide such that the weight percent of alpha-olefin oxide in the associative thickener is from 1 to 20 percent.

23. A functional fluid comprising a diluent selected from the group consisting of water, a freezing point lowering additive, or mixtures thereof, and the concentrate of claim 1 such that about 60 to 99.9 percent by weight of the fluid is a diluent.

24. A functional fluid comprising a diluent selected from the group consisting of water, a freezing point lowering additive, or mixtures thereof, and the concentrate of claim 2 such that about 60 to 99.9 percent by weight of the fluid is a diluent.

25. A functional fluid comprising a diluent selected from the group consisting of water, a freezing point lowering additive, or mixtures thereof, and the concentrate of claim 3 such that about 60 to 99.9 percent by weight of the fluid is a diluent.

26. A functional fluid comprising a diluent selected from the group consisting of water, a freezing point lowering additive, or mixtures thereof, and the concentrate of claim 4 such that about 60 to 99.9 percent by weight of the fluid is a diluent.

27. A functional fluid comprising a diluent selected from the group consisting of water, a freezing point lowering additive, or mixtures thereof, and the concentrate of claim 5 such that about 60 to 99.9 percent by weight of the fluid is a diluent.

28. A functional fluid comprising a diluent selected from the group consisting of water, a freezing point lowering additive, or mixtures thereof, and the concentrate of claim 6 such that about 60 to 99.9 percent by weight of the fluid is a diluent.

29. A functional fluid comprising a diluent selected from the group consisting of water, a freezing point lowering additive, or mixtures thereof, and the concentrate of claim 7 such that about 60 to 99.9 percent by weight of the fluid is a diluent.

30. A functional fluid comprising a diluent selected from the group consisting of water, a freezing point lowering additive, or mixtures thereof, and the concentrate of claim 8 such that about 60 to 99.9 percent by weight of the fluid is a diluent.

31. A functional fluid comprising a diluent selected from the group consisting of water, a freezing point lowering additive, or mixtures thereof, and the concentrate of claim 9 such that about 60 to 99.9 percent by weight of the fluid is a diluent.

32. A functional fluid comprising a diluent selected from the group consisting of water, a freezing point lowering additive, or mixtures thereof, and the concentrate of claim 10 such that about 60 to 99.9 percent by weight of the fluid is a diluent.

33. A functional fluid comprising a diluent selected from the group consisting of water, a freezing point lowering additive, or mixtures thereof, and the concentrate of claim 11 such that about 60 to 99.9 percent by weight of the fluid is a diluent.

34. A functional fluid comprising a diluent selected from the group consisting of water, a freezing point lowering additive, or mixtures thereof, and the concentrate of claim 12 such that about 60 to 99.9 percent by weight of the fluid is a diluent.

35. A functional fluid comprising a diluent selected from the group consisting of water, a freezing point lowering additive, or mixtures thereof, and the concentrate of claim 13 such that about 60 to 99.9 percent by weight of the fluid is a diluent.

36. A functional fluid comprising a diluent selected from the group consisting of water, a freezing point lowering additive, or mixtures thereof, and the concentrate of claim 14 such that about 60 to 99.9 percent by weight of the fluid is a diluent.

37. A functional fluid comprising a diluent selected from the group consisting of water, a freezing point lowering additive, or mixtures thereof, and the concentrate of claim 15 such that about 60 to 99.9 percent by weight of the fluid is a diluent.

38. A functional fluid comprising a diluent selected from the group consisting of water, a freezing point lowering additive, or mixtures thereof, and the concentrate of claim 16 such that about 60 to 99.9 percent by weight of the fluid is a diluent.

39. A functional fluid comprising a diluent selected from the group consisting of water, a freezing point lowering additive, or mixtures thereof, and the concentrate of claim 17 such that about 60 to 99.9 percent by weight of the fluid is a diluent.

40. A functional fluid comprising a diluent selected from the group consisting of water, a freezing point lowering additive, or mixtures thereof, and the concentrate of claim 18 such that about 60 to 99.9 percent by weight of the fluid is a diluent.

41. A functional fluid comprising a diluent selected from the group consisting of water, a freezing point lowering additive, or mixtures thereof, and the concentrate of claim 19 such that about 60 to 99.9 percent by weight of the fluid is a diluent.

42. A functional fluid comprising a diluent selected from the group consisting of water, a freezing point lowering additive, or mixtures thereof, and the concentrate of claim 20 such that about 60 to 99.9 percent by weight of the fluid is a diluent.

43. A functional fluid comprising a diluent selected from the group consisting of water, a freezing point lowering additive, or mixtures thereof, and the concentrate of claim 21 such that about 60 to 99.9 percent by weight of the fluid is a diluent.

44. A functional fluid comprising a diluent selected from the group consisting of water, a freezing point lowering additive, or mixtures thereof, and the concentrate of claim 22 such that about 60 to 99.9 percent by weight of the fluid is a diluent.

* * * * *

UNITED STATES PATENT AND TRADEMARK OFFICE

CERTIFICATE OF CORRECTION

PATENT NO. : 4,626,366

DATED : December 2, 1986

INVENTOR(S) : Mark A. Frentrup et al

It is certified that error appears in the above-identified patent and that said Letters Patent is hereby corrected as shown below:

Column 7, claim 1, line 52, delete "comprises" and insert therefor ---consisting essentially of---.

Column 7, claim 1, line 53, delete "cloud point raising additive" and insert therefor ---metal dialkyldithiophosphate---.

Column 8, claim 1, line 3, delete "cloud point raising additive" and insert therefor ---metal dialkyldithiophosphate---.

Column 8, claim 3, line 9, delete "cloud point raising additive" and insert therefor ---metal dialkyldithiophosphate---.

UNITED STATES PATENT AND TRADEMARK OFFICE

CERTIFICATE OF CORRECTION

PATENT NO. : 4,626,366

DATED : December 2, 1986

INVENTOR(S) : Mark A. Frentrup et al

It is certified that error appears in the above-identified patent and that said Letters Patent is hereby corrected as shown below:

Column 7, claim 1, line 52, delete the word "which".

Signed and Sealed this

Thirty-first Day of March, 1987

*Attest:*

DONALD J. QUIGG

*Attesting Officer*

*Commissioner of Patents and Trademarks*